United States Patent [19]

McGinley

[11] Patent Number: 4,971,390

[45] Date of Patent: Nov. 20, 1990

[54] SAFETY LOCKER DRAWER FOR USE WITH A CHAIR

[76] Inventor: John McGinley, 4539 Colbath Ave. #14, Sherman Oaks, Calif. 91423

[21] Appl. No.: 435,736

[22] Filed: Nov. 13, 1989

[51] Int. Cl.[5] ..... A47C 7/62

[52] U.S. Cl. ..... 297/192; 5/308; 312/345

[58] Field of Search ..... 297/183, 192; 5/308; 312/342, 345

[56] References Cited

U.S. PATENT DOCUMENTS

| | | | |
|---|---|---|---|
| 1,289,897 | 12/1918 | Phillips | 5/308 |
| 1,631,811 | 6/1927 | Guenther . | |
| 2,567,630 | 9/1951 | Whittier et al. | 5/308 |
| 2,885,694 | 5/1959 | Ulur | 5/308 |
| 4,061,395 | 12/1977 | Boole | 297/192 |
| 4,074,918 | 2/1978 | Kotzin, Jr. . | |
| 4,624,502 | 11/1986 | Boole | 297/192 |
| 4,790,432 | 12/1988 | Rees | 297/192 X |
| 4,811,438 | 3/1989 | Simpson | 297/192 X |

FOREIGN PATENT DOCUMENTS

| | | |
|---|---|---|
| 112314 | 10/1964 | Czechoslovakia . |
| 12587 | of 1914 | United Kingdom . |

*Primary Examiner*—Peter R. Brown

*Attorney, Agent, or Firm*—Thomas I. Rozsa

[57] ABSTRACT

A lockable drawer assembly which is fitted and designed to be fastened beneath a chair and in particular to a beach chair, both of the sitting type and reclining type. The assembly includes a specialized attaching means that permits the assembly to be attached to a chair of any desired width. The assembly incorporates a slidable drawer which is slidably attached to a support structure which in turn further includes an attaching arrangement which permits the support structure to be attached to the underside of the support bars of a chair and the drawer further includes a locking arrangement which securely locks the drawer within the support structure. A boss prevents the drawer from being completely pulled out of the support structure.

15 Claims, 2 Drawing Sheets

Fig. 1.
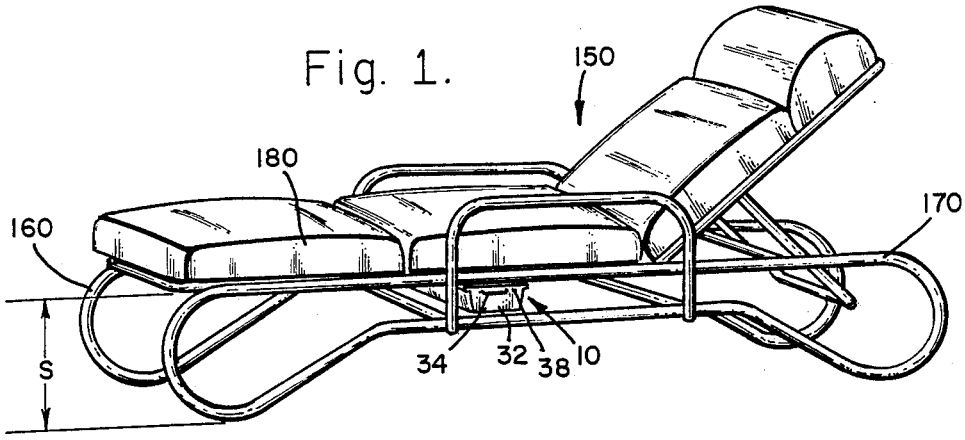
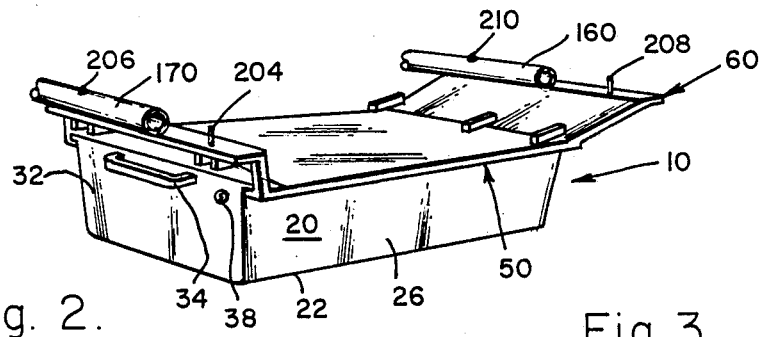
Fig. 2.
Fig. 3.
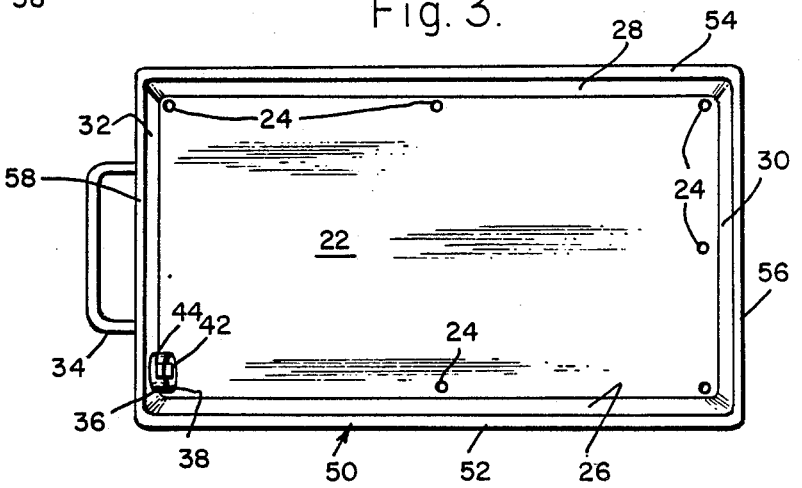
Fig. 4.
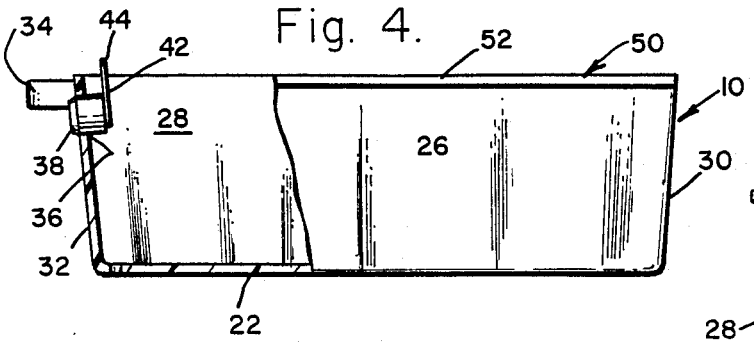
Fig. 5.
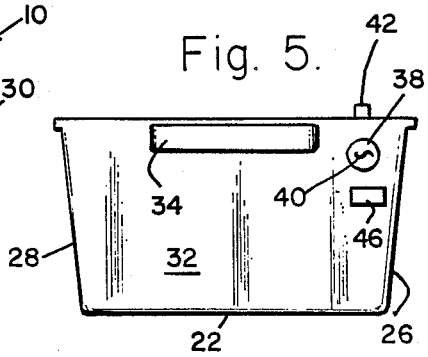

SAFETY LOCKER DRAWER FOR USE WITH A CHAIR

BACKGROUND OF THE INVENTION

1. Field of the Invention

In general, the present invention relates to the field of safety and security devices which are used to protect valuable articles when the owner is not in the vicinity of the article. More particularly, the present invention relates to the field of safety lockers which can be used in conjunction with a chair in order to store valuables such as a wallet, keys, jewelry, and a watch when the owner is not sitting on or in the vicinity of the chair.

2. Description of the Prior Art

In general, the concept of having a drawer or locker set beneath of a chair is known. The following patents are illustrative of the known prior art in this area:

1. Czechoslovakian Patent No. 112314 issued in 1964.
2. U.S. Pat. No. 4,074,918 issued to Kotzin, Jr. on Feb. 21, 1987 for "Chair And Detachable Locker".
3. British Pat. No. 12,587 issued to Harrison in 1914. Only the drawings were available from this very old patent.
4. U.S. Pat. No. 1,631,811 issued to Guenther in 1927 for "Convertible Chair".
5. U.S. Pat. No. 4,061,395 issued to Boole in 1977 for "Portable Drawer Assembly ".
6. U.S. Pat. No. 4,624,502 issued to Boole in 1986 for "Portable Drawer Assembly".
7. U.S. Pat. No. 4,790,432 issued to Rees in 1988 for "Tackle Box Assembly".

Patent No. 4,074,918 issued to Kotzin discloses a chair including a detachable locker. The locker basically is of an open screen type which would make it difficult to put small objects in it and further permits the objects to be easily picked out of the locker. The locker is also removable from the chair.

The pictures from the British Pat. No. 12,587 issued in 1914 also disclose a type of container resting underneath a chair in which the container is supported by a bar member C.

The Czechoslovakian Patent discloses a chair which can be folded up and moved from location to location. Beneath the chair is a drawer which has partitions in it for retaining various articles.

U.S. Pat. No. 1,631,811 to Guenther discloses another portable chair having a drawer which can be fitted into a chair and slid in place as indicated in FIG. 2. The drawer has no locking mechanism. This concept is also further elaborated in the two patents to Boole, Numbers 4,061,395 and 4,624,502 where the drawer can be expanded to fit under various sized chairs.

U.S. Pat. No. 4,790,432 to Rees discloses the concept of having a tackle box fitted underneath a chair.

While the prior art discloses the overall concept of a drawer or locker under a chair, what is not disclosed is an efficient and lockable drawer locker system for retaining valuable articles, which is affixed to a chair in a manner by which the assembly cannot be easily removed. Further, the system permits the drawer to be attached to any multiplicity of beach chairs, regardless of the particular width of the chair.

SUMMARY OF THE PRESENT INVENTION

The present invention relates to a specialized lockable drawer assembly which is fitted and designed to be fastened beneath a chair and in particular to a beach chair, both of the sitting type and reclining type. The present invention further relates to a specialized lockable drawer assembly with specialized attaching means that permits the assembly to be attached to a chair of any desired width.

It has been discovered, according to the present invention, that if a structure comprising a slidable drawer is slidably attached to a support structure which in turn further comprises an attaching arrangement which permits the support structure to be attached to the underside of the support bars of a chair and the drawer further comprises a locking arrangement which securely locks the drawer within the support structure, then the arrangement can be a secure locking vault in which valuables can be safely stored when the owner is away from the location of the chair.

It is therefore an object of the present invention to provide a secure storage means on a chair so that a user can lock valuables in the storage means and leave the location of the chair.

It is a further object of the present invention to provide a secure storage means attached to a beach chair, both a sitting type and reclining type beach chair, which permits a user to lock valuables such as glasses, rings, watches, other jewelry, keys and a wallet in the locker when the user goes swimming.

It is an additional object of the present invention to provide a storage means which can be accommodated to fit any desired width of chair.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of a reclining type beach chair with the present invention safety locker drawer in place.

FIG. 2 is a perspective view of the entire present invention safety locker drawer assembly showing a portion of the tubes from a beach chair to which the assembly is attached.

FIG. 3 is a top plan view of the drawer portion of the safety locker drawer assembly.

FIG. 4 is a side elevational view in partial crosssection of the drawer portion of the safety locker drawer assembly, illustrated in partial cross-section to show the interior locking arrangement.

FIG. 5 is a front elevational view of the drawer portion of the safety locker drawer assembly.

DETAILED DESCRIPTION OF THE PREFERRED EMBODIMENT

Figure 6:
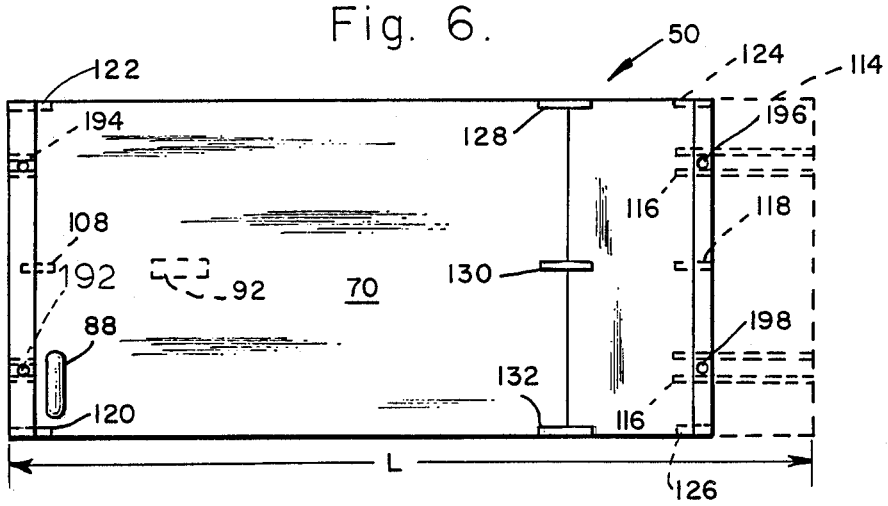
FIG. 6 is a top plan view of the support structure and the attachment member of the safety locker drawer assembly, with the adjustable length feature of the attachment portion partially illustrated with dotted lines.

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

The present invention safety locker drawer assembly 10 comprises two primary portions, a drawer portion and a support and attachment member portion. First, the drawer portion 20 will be described. Referring to FIGS. 2 through 5, the drawer portion 20 is essentially a generally rectangular drawer member, comprising a flat bottom 22 which includes a multiplicity of small drain holes 24 at various spaced locations on the bottom 22. The drawer portion 20 further comprises a pair of generally parallel lengthwise sidewalls 26 and 28, a rear transverse wall 30 and a front transverse wall 32. The bottom 22, lengthwise sidewalls 26 and 28, rear transverse wall 30 and front transverse wall 32 form a box like structure having an open top. Front transverse wall 32 further comprises a handle 34 which can be grasped by a hand to push and pull the drawer portion 20. In the preferred embodiment, the handle 34 is generally centered in the widthwise direction on the front transverse wall 32. Offset to one side of the handle 34 is an opening 36 in front transverse wall 32 which houses a lock barrel 38. The lock barrel 38 houses a key slot 40 by which an inserted key can operate a transverse bolt 42 at the back of the lock barrel 38. In the closed position as illustrated in FIG. 4, the transverse bolt 42 is in the raised position so that its tip 44 will abut a raised portion in the interior of the support structure of the assembly 10, thereby preventing the drawer portion 20 from being pulled out of the support structure portion. When the transverse bolt 42 is rotated to extend parallel to the front transverse wall 32, then the drawer portion 20 can be pulled out of the support structure. This simple locking arrangement provides an effective security device. As an optional embellishment, the front transverse wall 32 may support a plate 46 which may have an insignia thereon, a number for the particular drawer thereon or both. A transverse ledge 50 is attached to the two lengthwise sidewalls 26 and 28 and to the two transverse walls 30 and 32. The transverse ledge 50 has two lengthwise sections 52 and 54 at the top of lengthwise sidewalls 26 and 28 respectively and two transverse sections 56 and 58 at the top of rear transverse wall 30 and front transverse wall 32 respectively.

Figure 7:
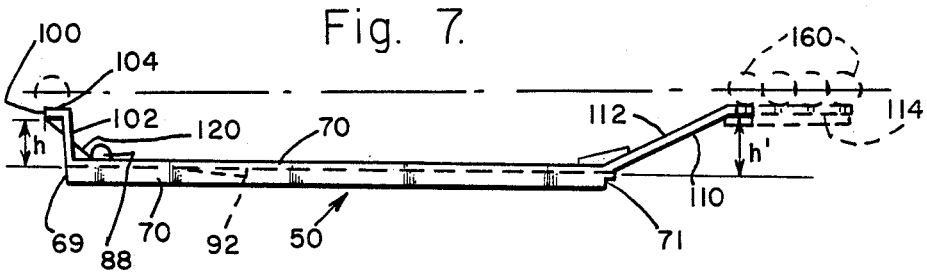
FIG. 7 is a side elevational view of the support structure and the attachment member of the safety locker drawer assembly.
Figure 8:
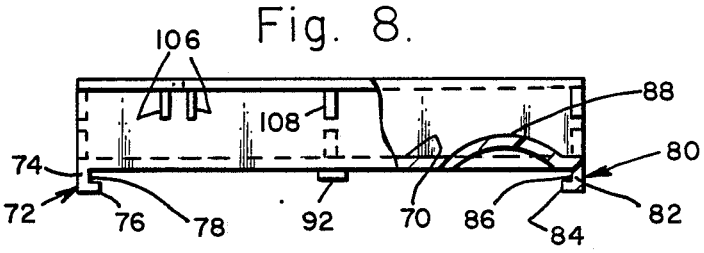
FIG. 8 is a front elevational view in partial cross-section of the support structure and the attachment member of the safety locker drawer assembly, illustrated in partial cross-section to show the locking arrangement.
Figure 9:
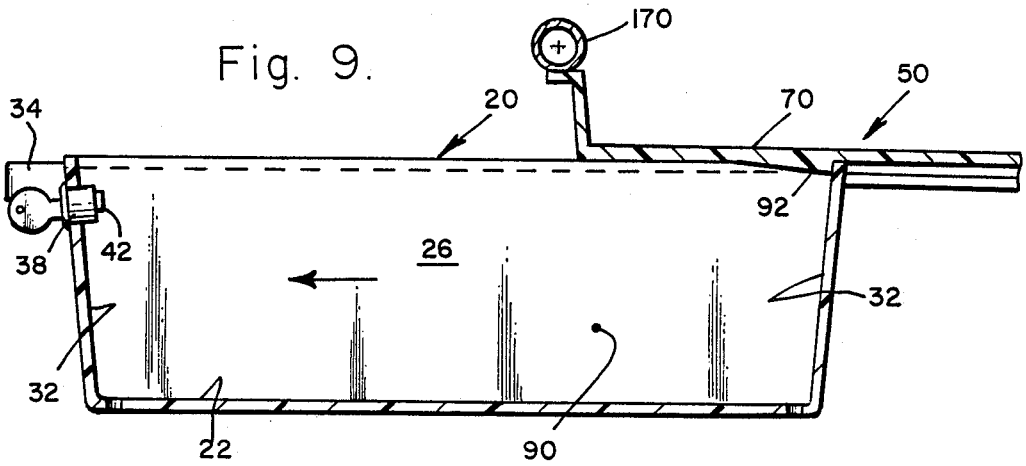
FIG. 9 is a cross-sectional view of the entire present invention safety locker drawer assembly showing the drawer pulled out to its maximum open position and stopped from being entirely pulled out of the support structure by a boss on the support structure.

The second portion of the present invention safety locker drawer assembly 10 comprises the support and attachment member portion 60. Referring to FIGS. 6 through 8, the support and attachment member portion 60 comprises a top platform 70 and a pair of support limbs 100 and 110. Top platform 70 further comprises a pair of channel members 72 and 80 extending beneath the top member portion 70 and running the length of the top member portion 70 on either side. As illustrated in FIG. 8, first channel member 72 has a vertical portion 74 and an inwardly extending lip 76, defining an interior lengthwise channel 78. Similarly, second channel member 80 has a vertical portion 82 and an inwardly extending lip 84, defining an interior lengthwise channel 86. Lengthwise section 52 of transverse ledge 50 is designed to be slidably retained within channel 78 and lengthwise section 54 of transverse ledge 50 is designed to be slidably retained with channel 86. When the drawer portion 20 is thus retained in the top platform 70 by its two lengthwise transverse ledge sections 52 and 54, the drawer portion 20 can be slid in and out of top platform 70. When the drawer portion 20 is slid entirely into top platform 70, the top platform acts as a closing top to the drawer portion 20 so that it is entirely closed with the drawer's interior chamber 90 entirely enclosed and surrounded by bottom 22, lengthwise sidewalls 26 and 28, rear and front transverse walls 30 and 32 and top portion 70. Top portion 70 further comprises a recess area 88 adjacent its front to thereby accomodate the top 44 of transverse bolt 42 of the lock. At approximately its midlength area, the underside 71 of top 70 comprises a boss 92 which as best illustrated in FIG. 9 is slanted toward the rear. The boss 92 is flexible so that it can be pushed upward toward the top and the rear transverse wall 30 of drawer 20 is pushed against it when the drawer is first inserted into the top portion 70 through its transverse ledges as previously described. After the rear transverse wall 30 has passed the flexible boss 92, the boss pops back into its position and the rear transverse wall 30 cannot slide past the flexible boss 92 in the forward direction, thereby providing a stop means to prevent the drawer from being entirely pulled out. Referring to FIGS. 3 and 9, it will be noted that the central opening 24 in bottom 22 adjacent wall 30 is aligned with flexible transverse boss 92 so that a workman can slide an appropriate tool such as a thin screwdriver through the aligned opening 24 and up into the drawer 20 and push the flexible boss 92 upward so that the rear transverse wall 30 can be slid past the boss in case it is desired to remove the drawer 20 for repair, replacement, etc.

Attached to the front 69 of top 70 is front attachment member 100 which further comprises a vertical spacer section 102 and a lateral attaching section 104. Lateral attaching section 104 further comprises a multiplicity of strengthening ribs on its underside. One type of strengthening rib 106 has a pair of ribs adjacent one another. This type of rib is used to surround the attaching means which can be a one way screw, as will be discussed later on. The second type of rib 108 is a thick free standing rib. Attached to the rear 71 of top portion 70 is a rear attachment member 110 which comprises a slanted spacer section 112 and a lateral attaching section 114. The vertical height "h" of vertical spacer section 104 is slightly smaller than the vertical height "h'" of slanted spacer section 112 so that top portion 70 is at a slight downward tilt from its front end 69 to the rear end 71, to thereby enable water which collects in the drawer 20 to drain out of the holes 24 adjacent rear wall 30 of drawer 20. Lateral attaching section 114 is longer than lateral attaching section 104. This additional length on lateral attaching section 114 provides an optional length for the overall length "L" of the support and attachment member portion 60 where it is attached to the chair. The length "L" can thereby be sized to conform to the underside of the chair by cutting off any excess length of lateral attaching a section 114. Lateral attaching section 114 also has strengthening ribs 116 which are a pair of ribs adjacent one another which surround the attachment means and thicker independent strengthening rib 118 comparable to rib 108. Cross-brace strengthening ribs such as 120, 122, 124 and 126 can also be incorporated to further strengthen the attaching sections. In addition, top cross-brace strengthening ribs 128, 130 and 132 can also be incorporated to further strengthen the attachment of the top 70 to slanted spacer section 112.

The components of the safety locker can be of any desired strong material. In the perferred embodiment the drawer portion and the support and attachment member portion are made of heavy plastic or metal.

In operation, the support and attachment member portion 60 is attached to the underside of chair. In one embodiment for a reclining beach chair, the attachment is illustrated in FIG. 1. Beach chair 150 has a pair of spaced apart longitudinal support bars 160 and 170 which serve to provide the major framework of the breach chair. The support bars 160 and 170 are raised above the ground and there is a vertical space "S" between the cushions 180 on which the person rests and the ground. The present invention safety locker drawer for use with a chair 10 is sized to fit within this space "S" with the length "L" sized to be in alignment with the support bars 160 and 170. Lateral attaching section 104 is aligned with lateral support bar 170 and lateral attaching section 114 is cut to size so that it is aligned with a lateral support bar 160. In FIG. 7, several lateral support bars 160 are illustrated to show that the lateral attaching section 104 is of sufficient length to accommodate the conventional sizes of chairs. The attachment means is preferably a self tapping one way screw. In most situations, only fours such attachment means 204, 206, and 210 (see FIG. 2) are needed, two on each lateral attaching section. Self tapping one way screws 204 and 206 extend from the bottom of lateral attaching section 104 through openings 192 and 194 respectively through the lateral attaching section and into lateral support bar 170. The head of each self tapping one way screw is preferably surrounded by a dual support rib 106 for added strength. Similarly, self tapping one way screws 208 and 210 extend from the bottom of lateral attaching section 114 through openings 198 and 196 respectively through the lateral attaching section and into lateral support bar 160. The head of each self tapping one way screw is preferably surrounded by a dual support rib 116 for added strength. As illustrated in FIG. 1, with the present invention safety locker drawer for use with a chair 10 installed on chair 150 in this manner, the drawer 20 opens out a side of the chair 150.

Through use of the present invention, a person can take valuables such as a wallet, keys and a watch to a swimming pool area at a public facility or a hotel and then lock the valuables in the present invention 10 when he/she goes swimming, without having to worry about the items being stolen. The attachment feature of the present invention can accomomate any conventional width for a chair, sitting chair or beach chair. The locking mechanism assures that the drawer will not be opened in an unauthorized manner. the attaching means 192, 194, 196 and 198 assures that the entire assembly 10 cannot be easily removed from the chair 150. The boss 92 assures that the entire drawer 20 cannot be accidentally pulled out of the support and attaching portion 60. The drawer 20 and top section 70 are fitted for a tight close fit to permit small articles such as rings to be inserted in the drawer without fear that it will fall out or be slipped out by a thief. The slight slant of the attaching and support apparatus and drawer permit water which might collect in the drawer to drain out. Therefore, overall, the present invention provides a valuable security device to enable a user to lock valuables under a chair and leave the location of the chair such as to go swimming without having to constantly look back at the chair to make sure no-one is stealing their valuables.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A safety locker drawer for use with a chair having a pair of spaced apart widthwise supporting ribs, comprising:

a. a drawer portion further comprising,
   (i) a bottom having a multiplicity of openings extending therethrough at spaced locations of the bottom,
   (ii) a first lengthwise sidewall and a second lengthwise sidewall,
   (iii) a rear transverse wall and a front transverse wall,
   (iv) a handle attached to the front transverse wall,
   (v) a lock extending through an opening in the front transverse wall with its key slot exposed on the front transverse wall and a transverse bolt within the drawer,
   (vi) a transverse ledge attached to the top of the drawer having at least a first lengthwise section at the top of the first lengthwise sidewall and a second lengthwise section at the top of the second lengthwise sidewall;

b. a support and attachment member portion further comprising,
   (i) a top platform sized to fit over the top of the drawer to thereby cover the drawer and supporting a first lengthwise channel section beneath it to slidably receive and support said first lengthwise section of said transverse ledge and supporting a second lengthwise channel section beneath it to slidably receive and support said second lengthwise section of said transverse ledge,
   (ii) the top platform having a front edge aligned with the front transverse wall of the drawer and a rear edge aligned with the rear transverse wall of the drawer,
   (iii) the top including a recess area adjacent its front edge to receive the top portion of the transverse bolt of said lock,
   (iv) the top having a flexible boss on its undersurface to permit the rear transverse wall of the drawer to pass in one direction as the first and second lengthwise sections of the transverse ledge are slid into their respective receiving channels in the top but which does not permit the rear transverse wall to pass in the opposite direction thereby preventing the drawer from being entirely pulled out of the top, (v) a front attachment member including a vertical spacer section attached to the front edge of the top at one end and a lateral attaching section attached to the other end of the vertical spacer section, (vi) a rear attachment member including a slanted spacer section attached to the rear edge of the top at one end and an elongated lateral attaching section attached to the other end of the slanted spacer section, (vii) the vertical height of the vertical spacer section being greater than the vertical height of the slanted spacer section, (viii) the lengthwise distance between the lateral attaching section of the front attachment member and the lateral attaching section of the rear attachment member dimensioned to correspond the the distance between the widthwise supporting ribs of said chair; and c. one way attachment means wherein the lateral attaching section of the front attachment member is attached to one widthwise supporting rib of said chair and the lateral attaching section of the rear attachment member is attached to the other widthwise support rib of said chair such that the top and drawer rest beneath the chair and the drawer can slide to an open position beneath the chair.

2. A safety locker drawer in accordance with claim 2 wherein said one way attachment means are one-way self tapping screws.

3. A safety locker drawer in accordance with claim 1 wherein at least one of said multiplicity of openings on the bottom is aligned with said flexible boss member.

4. A safety locker drawer in accordance with claim 1 wherein said lateral attaching sections of the front and rear attachment members further comprise strengthening ribs adjacent the one way attachment means.

5. A safety locker drawer in accordance with in claim 4 wherein said lateral attaching sections of the front and rear attachment members further comprise additional strengthening ribs.

6. A safety locker drawer in accordance with claim 1 wherein said drawer portion and said support and attachment member portion are made of heavy plastic.

7. A safety locker drawer in accordance with claim 1 wherein said drawer portion and said support and attachment member portion are made of metal.

8. A safety locker drawer for use with a chair having a pair of spaced apart widthwise supporting ribs, comprising:

a. a drawer portion including a box section having a bottom, a rear wall, a front wall, and a pair of spaced apart lengthwise walls having a transverse ledge running along the top of the lengthwise walls, a locking mechanism extending through the front wall and including a transverse bolt positioned within the box section, and a handle on the front wall;

b. a support and attachment member portion further comprising, (i) a top platform sized to fit over the open top of the box section to thereby cover the drawer and supporting a first lengthwise channel section beneath it to slidably receive and support one of said transverse ledges and supporting a second lengthwise channel section beneath it to slidably receive and support the opposite transverse ledge, (ii) the top including a recess area to receive the top portion of the transverse bolt of said lock, (iii) the top having a flexible boss on its undersurface to permit the rear wall of the box section to pass in one direction as the transverse ledges are slid into their respective receiving channels in the top but which does not permit the rear wall to pass in the opposite direction thereby preventing the drawer from being entirely pulled out of the top, (iv) a front attachment member including a vertical spacer section attached to the top at one end and a lateral attaching section attached to the other end of the vertical spacer section, (v) a rear attachment member including a slanted spacer section attached to the top at one end and an elongated lateral attaching section attached to the other end of the slanted spacer section, (vi) the lengthwise distance between the lateral attaching section of the front attachment member and the lateral attaching section of the rear attachment member dimensioned to correspond the the distance between the widthwise supporting ribs of said chair; and c. one way attachment means wherein the lateral attaching section of the front attachment member is attached to one widthwise supporting rib of said chair and the lateral attaching section of the rear attachment member is attached to the other widthwise support rib of said chair such that the top and drawer rest beneath the chair and the drawer can slide to an open position beneath the chair.

9. A safety locker drawer in accordance with claim 8 wherein the vertical height of the vertical spacer section is greater than the vertical height of the slanted spacer section so that the top and drawer tilt at an angle.

10. A safety locker drawer in accordance with claim 8 wherein said one way attachment means are one-way self tapping screws.

11. A safety locker drawer in accordance with claim 8 wherein at least one of said multiplicity of openings in the bottom is aligned with said flexible boss member.

12. A safety locker drawer in accordance with claim 8 wherein said lateral attaching sections of the front and rear attachment members further comprise strengthening ribs adjacent the one way attachment means.

13. A safety locker drawer in accordance with in claim 12 wherein said lateral attaching sections of the front and rear attachment members further comprise additional strengthening ribs.

14. A safety locker drawer in accordance with claim 8 wherein said drawer portion and said support and attachment member portion are made of heavy plastic.

15. A safety locker drawer in accordance with claim 8 wherein said drawer portion and said support and attachment member portion are made of metal.

* * * * *